US008353660B2

(12) United States Patent
Lonardi

(10) Patent No.: US 8,353,660 B2
(45) Date of Patent: Jan. 15, 2013

(54) CHARGING DEVICE FOR DISTRIBUTING BULK MATERIAL

(75) Inventor: Emile Lonardi, Bascharage (LU)

(73) Assignee: Paul Wurth S.A., Luxembourg (LU)

( * ) Notice: Subject to any disclaimer, the term of this patent is extended or adjusted under 35 U.S.C. 154(b) by 61 days.

(21) Appl. No.: 12/865,025

(22) PCT Filed: Jan. 26, 2009

(86) PCT No.: PCT/EP2009/050842

§ 371 (c)(1),
(2), (4) Date: Jul. 28, 2010

(87) PCT Pub. No.: WO2009/095371

PCT Pub. Date: Aug. 6, 2009

(65) Prior Publication Data

US 2010/0329826 A1 Dec. 30, 2010

(30) Foreign Application Priority Data

Jan. 30, 2008 (LU) ..... 91412

(51) Int. Cl.
*B65G 11/12* (2006.01)

(52) U.S. Cl. ..... 414/206; 414/301; 110/116; 266/199; 193/16

(58) Field of Classification Search ..... 414/205, 414/206, 208, 300, 301; 110/113, 115, 116, 110/117; 384/461; 266/199; 193/16
See application file for complete search history.

(56) References Cited

U.S. PATENT DOCUMENTS 3,814,403 A * 6/1974 Legille ..... 414/208
(Continued)

FOREIGN PATENT DOCUMENTS

CN 2361637 2/2000
(Continued)

OTHER PUBLICATIONS

International Search Report PCT/EP2009/050842; Dated Apr. 3, 2009.

*Primary Examiner* — Saul Rodriguez
*Assistant Examiner* — Jonathan Snelting
(74) *Attorney, Agent, or Firm* — Cantor Colburn LLP

(57) ABSTRACT

A charging device (1 10; 210; 310; 410; 510; 610, 710) for distributing bulk material in an enclosure, in particular in a shaft furnace comprises a stationary housing (12) that supports a rotatable structure (14) carrying adjustable distribution means (16). Distribution of bulk material in circumferential direction is achieved by rotation of the distribution means (16) together with the rotatable structure (14). Distribution of bulk material in radial direction is achieved by adjustment of the distribution means (16). For rotating the distribution means, usually about the central axis (A) of the charging device, the device (1 10; 210; 310; 410; 510; 610, 710) includes a first rolling bearing (122) with a first stationary race (124; 324) that bears a first rotary race (128). The first rotary race is coupled to a first gear ring (130; 430; 530; 730) that cooperates with a first drive (50) for rotating the rotatable structure and thereby the distribution means. For adjusting the distribution means, the device includes a second rolling bearing (132) having a second stationary race (134; 334) that bears a second rotary race (138). The second rotary race is coupled to a second gear ring (140) that cooperates with a second drive (60) for adjusting the distribution means. According to the invention, the first rotary race (128) is arranged radially inward with respect to the second rotary race (138), the first stationary race (124; 324) is arranged radially inward with respect to the second stationary race (134; 334) and the second rolling bearing (132) axially overlaps the first rolling bearing (122).

20 Claims, 8 Drawing Sheets

U.S. PATENT DOCUMENTS

| | | | | |
|---|---|---|---|---|
| 3,880,302 | A | 4/1975 | Legille | |
| 4,273,492 | A * | 6/1981 | Legille et al. | 414/160 |
| 4,368,813 | A * | 1/1983 | Mailliet | 193/3 |
| 4,526,536 | A * | 7/1985 | Legille et al. | 432/238 |
| 5,228,845 | A * | 7/1993 | Steele | 418/55.1 |
| 6,213,275 | B1 * | 4/2001 | Lonardi et al. | 193/16 |
| 6,540,958 | B1 * | 4/2003 | Heinrich et al. | 266/199 |
| 6,981,831 | B2 * | 1/2006 | Lonardi et al. | 414/174 |
| 2003/0180129 | A1 | 9/2003 | Lonardi | |

FOREIGN PATENT DOCUMENTS

| | | | |
|---|---|---|---|
| DE | 19911637 | A1 | 7/2000 |
| EP | 2595815 | | 12/2003 |
| EP | 1453983 | B1 | 1/2006 |
| SU | 1669988 | A1 | 4/1989 |

* cited by examiner

CHARGING DEVICE FOR DISTRIBUTING BULK MATERIAL

TECHNICAL FIELD

The present invention generally relates to a charging device for distributing bulk material for example in a metallurgical reactor such as a blast furnace.

BACKGROUND

During the last decades, a charging system well known by the name "bell-less top" (BLT) has found widespread use throughout the world for charging blast furnaces. This system includes a charging device with a distribution chute that is mounted rotatable about the vertical furnace axis and pivotable about a horizontal axis for distributing bulk material on the stockline. The charging device is further provided with a gear mechanism cooperating with respective drives for rotating and pivoting the distribution chute according to the desired charging profile. By rotating the chute about the vertical furnace axis and by varying the inclination of the chute, it is possible to direct bulk material (burden) to virtually any point of the charging surface. Accordingly, besides many other advantages, the BLT system enables a wide variety of charging profiles due to its versatility in distributing the burden on the charging surface.

An example of the above type of charging device is disclosed in U.S. Pat. No. 3,880,302. With respect to FIG. 2, this patent discloses a charging device for distributing bulk material in a shaft furnace. This device comprises a stationary housing 204 supporting a rotatable structure 228, 234, 236 that carries adjustable distribution means in the form of a pivotally adjustable distribution chute 208. Rotation of the rotatable structure 228, 234, 236 allows circumferential distribution of bulk material whereas pivotally adjusting the distribution chute 208 allows radial distribution of bulk material. In this device, a first rolling bearing comprises a first stationary race 214 bearing, by groups of rollers 216, 218, 220, a first rotary race that is coupled to a first gear ring 212. The gear ring 212 cooperates with a first drive 1 for rotating the rotatable structure 228, 234, 236. A second rolling bearing comprises a second stationary race 254 bears, by groups of rollers 256, 258, 260, a second rotary race coupled to a second gear ring 242. The second gear ring 242 cooperates with a second drive 25 for adjusting the pitch angle of the distribution chute 208. Charging devices based on the design disclosed in U.S. Pat. No. 3,880,302 have proven very successful and consequently found widespread use in industry over the last decades. Nevertheless, their design leaves room for further improvement, e.g. as regards overall construction height of the charging device. In fact, as seen in FIG. 2 of this patent, a certain minimum height is necessarily taken up by the charging device due to space required for the disposition of its numerous components, e.g. gear rings 212, 242, bearings 216, 218, 220; 256, 258, 260 and gear boxes 270, 272 for rotating and pivoting the chute 208. Chinese utility model no CN 2595815 Y proposes a charging device with a housing supporting a rotatable structure that carries a distribution chute in pivotally adjustable manner. In this design, a first gear ring for rotating the structure has a diameter considerably smaller than an inwardly facing second gear ring for pivoting the chute. Thereby, a certain reduction in height could be achieved since the first gear ring and the second gear ring can be arranged in vertically overlapping manner, i.e. at substantially identical axial locations. With the known prior art devices, assembly and disassembly of the charging device, especially for initial on-site installation but also for maintenance, is however relatively complicated and time-consuming among others due to the arrangement of rolling bearings and gear rings.

BRIEF SUMMARY

The invention provides a charging device the design of which allows for simplified assembly.

This charging device is designed for distributing bulk material in an enclosure, in particular in a shaft furnace. To this effect, the device comprises a stationary housing that supports a rotatable structure. The structure carries in adjustable manner a distribution means, typically a distribution chute. Distribution of bulk material in circumferential direction is achieved by rotation of the distribution means together with the rotatable structure. Distribution of bulk material in radial direction is achieved by adjustment, typically by pivotal adjustment, of the distribution means. For rotating the distribution means, usually about the central axis of the charging device, the device includes a first rolling bearing with a first stationary race that bears a first rotary race. The first rotary race is coupled to a first gear ring that cooperates with a first drive for rotating the rotatable structure and thereby the distribution means. For adjusting the distribution means, the device includes a second rolling bearing having a second stationary race that bears a second rotary race. The second rotary race is coupled to a second gear ring that cooperates with a second drive for adjusting the distribution means, typically for pivoting the latter.

According to an exemplary embodiment of the invention, the charging device has a stationary race unit having an inner side presenting the first stationary race and an outer side presenting the second stationary race. More specifically, the stationary race unit is thereby configured so that the first rotary race is arranged radially inward with respect to the second rotary race and the first stationary race is arranged radially inward with respect to the second stationary race. In other words, the stationary races are arranged as a unit in between the rotary races. In order to reduce constructional height, the second rolling bearing axially overlaps the first rolling bearing. As will be appreciated, the radial orientations and locations of the races inherent to the proposed stationary race unit enable simplified assembly and disassembly of the charging device.

As will be noted in the present context, "to axially overlap" means that the first rolling bearing is dimensioned and placed so as to occupy at least part of the cylindrical volume located within the annular space occupied by the second bearing, i.e. at least part of the volume delimited by the inner radius and the bearing width (axial dimension) of the second bearing. In fact, with the first rotary and stationary races each having a substantially smaller rolling surface diameters than the second rotary and stationary races respectively, the first rolling bearing can have radial dimensions that let it fit inside the second rolling bearing. Thereby, the latter can be arranged such that it at least partially contains or overlaps the former. By virtue of an at least partially nested configuration of the bearings, the overall height of construction of the charging device can be reduced.

As will further be noted, in the present context the expression "unit" refers to a device that may be made of several parts but has one specific function, namely providing stationary races.

In a particularly compact and preferred embodiment, the device comprises a single assembly of double-sided parts serving as a stationary race unit, each part having an inner side presenting a portion of the first stationary race and an outer side presenting a portion of the second stationary race. Alternatively, the unit may be made of a first stationary race bearing the first rotary race and a separate second stationary race bearing the second rotary race, the separate stationary races being arranged proximate to each other, e.g. side-by-side.

To maximize compactness in vertical direction, the stationary races are preferably arranged such that the first and second rolling bearings have identical or at least closely located axial bearing locations, i.e. bearing locations distant by less than half the smallest bearing width (i.e. the axial dimension of the smallest bearing). In case of identical axial bearing locations and identical bearing widths, the first rolling bearing may be fully nested inside the space confined by the second rolling bearing. In order to further reduce the vertical construction height of the device, the stationary races may be attached immediately to the underside of a top cover plate of the stationary housing.

In a structurally simple embodiment enabling axial overlap of the bearings, the first gear ring for rotating the rotatable structure has a smaller pitch circle diameter than the second gear ring for adjusting the distribution means. For further structural simplification, the first gear ring can have gear teeth facing radially inward while the second gear ring has gear teeth facing radially outward. Preferably, the first rotary race and the first gear ring are integrally formed. This applies also to the second rotary race and the second gear ring. In a preferred embodiment, the first rolling bearing is a combined radial and axial thrust bearing of the roller bearing type. In the latter embodiment, the rotatable structure is preferably fixed directly to the first rotary race by means of a connection flange.

In a typical application of the charging device, the distribution means comprises a distribution chute supported in angularly adjustable manner on the rotatable support. This kind of chute is typically pivotable about a pivoting axis perpendicular to the axis of rotation of the structure. In this case, the device further includes an adjustment transmission operable by means of the second gear ring for setting the pivoting angle of the distribution chute.

As will be understood, the proposed charging device can be used for charging any kind of enclosure. More specifically, it can be used for charging bulk reactants into a reactor, in particular for charging burden into a metallurgical reactor such as a blast furnace.

BRIEF DESCRIPTION OF THE FIGURES

Further details and advantages of the present invention will be apparent from the following detailed description of several not limiting embodiments with reference to the attached drawings, wherein.

Throughout the drawings, identical reference numerals are used to indicate identical or similar parts.

DETAILED DESCRIPTION

Initially, it shall be noted that each vertical sectional view in FIGS. 1-7 is a composed view of half of a first vertical plane (left hand side of FIGS. 1-7) and half of a second vertical plane (right hand side of FIGS. 1-7) that intersects the first plane at right angle in the central axis A of the illustrated charging device.

Figure 1:
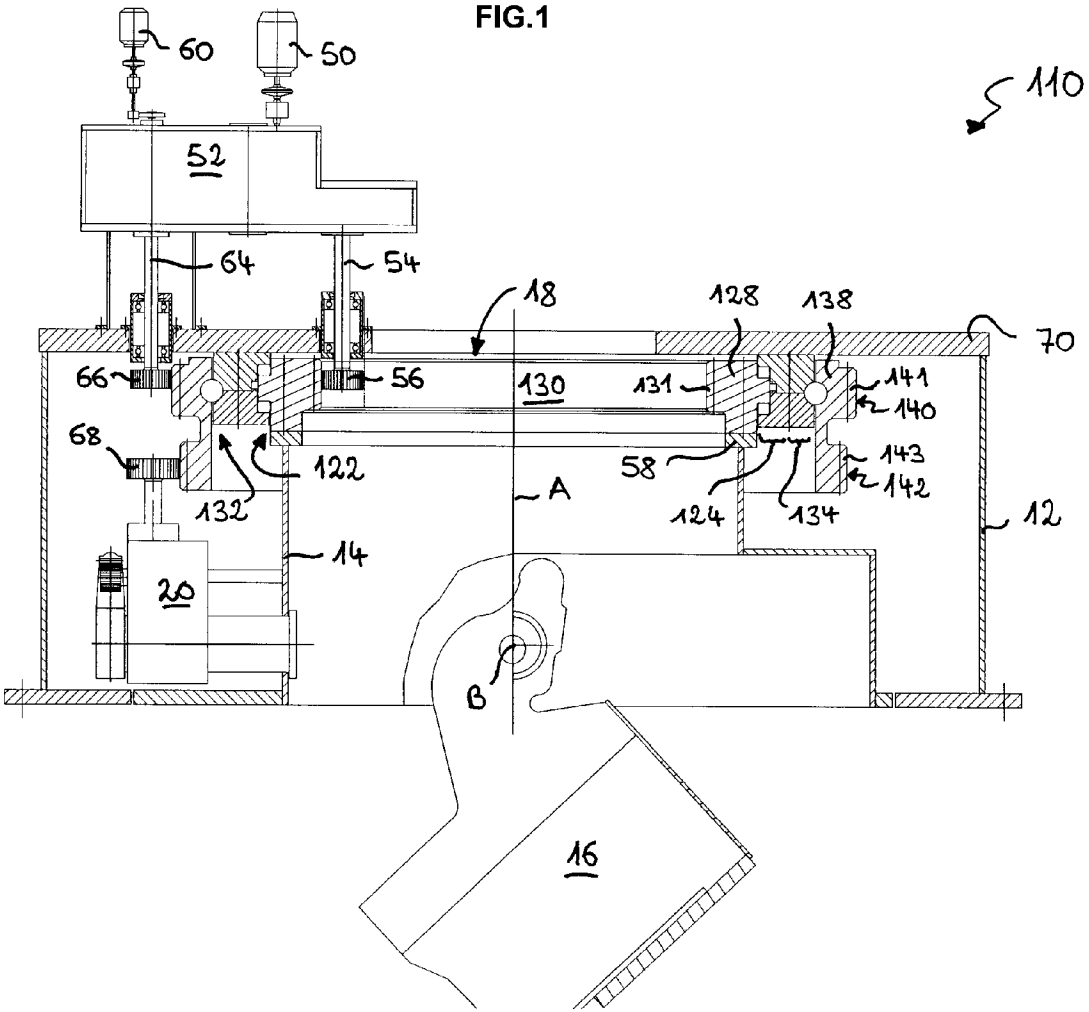
FIG. 1 is a vertical cross sectional view schematically showing a charging device according to a first embodiment.

FIG. 1 illustrates a charging device 1 10 for distributing bulk material in an enclosure such as a metallurgical reactor. In a typical but not limiting application, the charging device 1 10 is installed on the throat of a blast furnace (not shown) with the central axis A of the device coinciding with the shaft axis. The charging device 1 10 comprises a stationary housing 12. A rotatable structure 14 is rotatably mounted inside the housing 12 for rotation about vertical axis A. The structure 14 carries a distribution means such as a pivotally adjustable distribution chute 16 (only partially shown in a side elevation that belongs to the right hand side sectional view of FIG. 1). The chute 16 is mounted to the rotatable structure 14 on shafts for pivoting the chute 16 about a horizontal axis B, i.e. for angularly adjusting the chute position. Rotation of the rotatable structure 14 and therewith the distribution chute 16 about axis A allows distributing bulk charge material (not shown) circumferentially inside the enclosure. Pivotal adjustment of the distribution chute 16 about axis B allows setting the radius of the circumferential charging profile inside the enclosure. In other words, adjusting the angular or pivotal position of the chute 16 relative to the structure 14 enables radial distribution of charge material (e.g. lump iron ore and coke in case of a blast furnace). For pivotable adjustment of the chute 16, the rotatable structure 14 supports two radially opposite gear boxes 20 (only one being shown in the left hand side of FIG. 1) operatively connected to lateral supporting flanges of the distribution chute 16 and acting as a transmission for adjustment of the chute 16. Although not shown in FIGS. 1-7, the charging device 1 10 is typically arranged underneath a charge material feed installation comprising storage hoppers that act as pressure locks and communicate with a central feed opening 18 of the charging device 1 10. During operation, charge material is fed in bulk onto the distribution chute 16 through the central feed opening 18 of the charging device 1 10.

Figure 8:
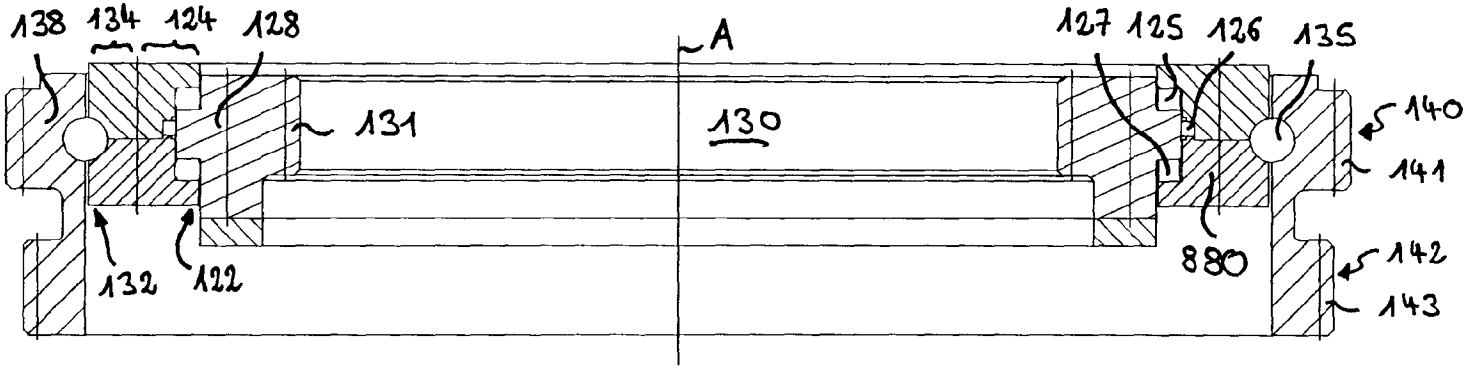
FIG. 8 is a vertical cross sectional view of a rolling element bearing arrangement comprising a first and a second rolling bearing for use in the first, second, fourth or fifth embodiment of the invention.

The stationary housing 12 supports the rotatable structure 14 in rotatable manner by means of a first rolling bearing 122 (also commonly called rolling-element bearing or rolling contact bearing). The first rolling bearing comprises a stationary race 124 fixed to the housing 12. The stationary race 124 bears a rotary race 128 by means of groups of cylindrical rollers 125, 126, 127 as best seen in FIG. 8, which is an enlarged view of a bearing arrangement suitable for use in the embodiment of FIG. 1. The first rotary race 128 is coupled to a first gear (or toothed wheel) ring 130 with teeth 131 facing radially inward with respect to axis A. More specifically, in a preferred embodiment, the first gear ring 130 is integrally formed with the first rotary race 128. As seen in FIG. 8, the first rolling-element bearing 122 is of the roller bearing type and more specifically a combined radial and axial thrust bearing comprising two groups of conical or cylindrical horizontal rollers 125, 127 and one group of conical or cylindrical vertical rollers 126. Other suitable types of radial and axial thrust bearings are not excluded. In fact, as appears from FIG. 1, the first rolling bearing 122 is designed to support, on the one hand, a considerable axial load of several metric tons (e.g. ca. 25'000 kg) due to the weight of the rotatable structure 14, including its accessories e.g. the chute 16 and the gear boxes 20, and the weight of charge material on the chute 16. On the other hand, the rolling-element bearing 122 is also designed to support the radial load caused by rotation of rotatable structure 14 (including accessories and charge material on the chute 16).

As further seen in FIG. 1, a second rolling bearing 132 of the charging device 1 10 comprises a second stationary race 134 that bears a second rotary race 138 e.g. on bearing balls 135 (as seen in FIG. 8). The stationary race 134 is coupled to, and more preferably integrally formed with, a second gear ring 140 which has teeth 141 facing radially outward i.e. in the opposite direction of teeth 131 of the first gear ring 130. As will be appreciated, the second rolling bearing 132 is designed to support an essentially radial load (gear rings 140 and 142, see below) since it need not support a considerable load in axial direction. The second rolling bearing 132 may be of any suitable type, e.g. a ball bearing as shown in FIG. 1, or alternatively, e.g. a radial roller, needle or tapered roller bearing.

Operation of the charging device 1 10 is as follows. The first gear ring 130 cooperates with a first drive 50 for rotating the rotatable structure 14. More specifically, the first drive 50 is operatively connected to a planetary gear train 52 for driving a first shaft 54. The first shaft 54 carries a first pinion 56 that is arranged radially inward of the first gear ring 130. The first pinion 56 meshes with the inward facing first gear ring 130 in order to communicate rotation to the rotatable structure 14 by action of the first drive 50. Accordingly, the rotatable structure 14 is fixed by means of a connection flange 58 to the first rotary race 128 and the first gear ring 130. Consequently, as set out above, the housing 12 rotatably supports the load of the rotatable structure 14, including the chute 16 and any charge material thereon, by means of the first rolling bearing 122.

Figure 9:
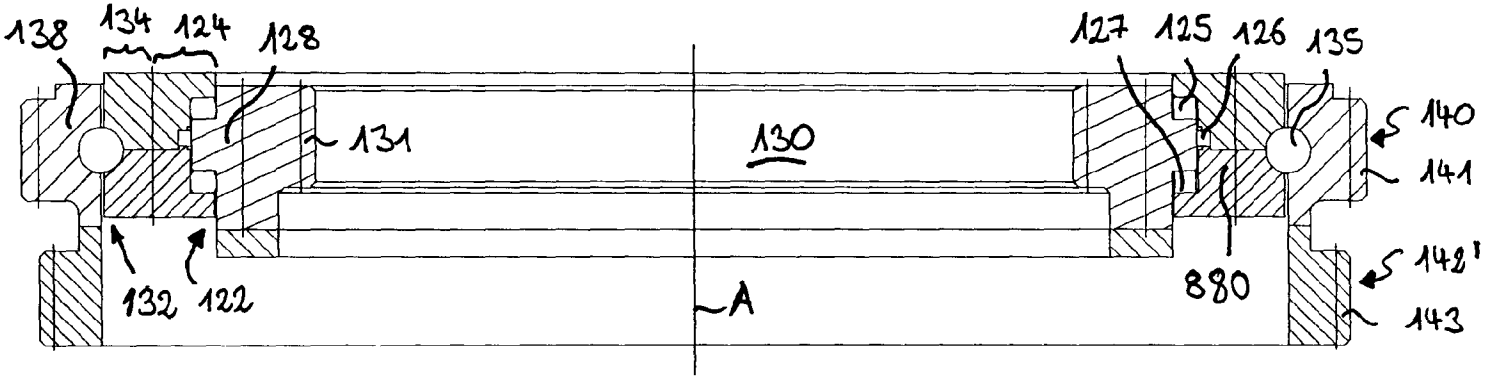
FIG. 9 is a vertical cross sectional view of an alternative rolling element bearing arrangement comprising a first and a second rolling bearing for use in the first, second, fourth or fifth embodiment of the invention.

The second gear ring 140 cooperates with an auxiliary second drive 60 for adjusting the angular position of the distribution chute 16. More specifically, the second drive 60 is operatively connected to the planetary gear train 52 for driving a second shaft 64 which is offset with respect to the first shaft 54 and carries a second pinion 66 that meshes with the second gear ring 140. A third gear ring 142 with gear teeth 143 facing radially outward is coupled to the second gear ring 140 and the second rotary race 138. The third gear ring 142 meshes with a pair of third pinions 68 (only one pinion 68 being shown) mounted on the drive shaft of each gear box 20 for pivoting the chute 16. As seen in FIG. 1, the second shaft 64 and the second pinion 66 are arranged radially outward of the second gear ring 140. As seen in FIG. 8 the third gear ring 142 can be integrally formed with the second gear ring 140 and the second rotary race 138. Alternatively, as shown in FIG. 9, a third gear ring 142' may be fixed as a separate part to the downward front surface of the second gear ring 140, and thereby also to the second rotary race 138. In any case, although not necessary, it is preferable that the second rotary race 138 and the second gear ring 140 are integrally formed.

The planetary gear train 52, 452, 552, 652, 752 shown in FIGS. 1-7 is provided for rotating the second gear ring 140 at the same speed of rotation as the first gear ring 130 by action of the first drive 50 only. In other words, the auxiliary second drive 60 is operated only for relative rotation of the second gear ring 140 relative to the first gear ring 130. Further details of a suitable planetary gear train 52, 452, 552, 652, 752 are disclosed in U.S. Pat. No. 3,880,302 and not repeated here for the sake of conciseness. It shall be noted that a planetary gear train 52 is not essential to the operation of the charging device 1 10, an arrangement of two drives coupled to functionally and structurally independent drivetrains for driving the gear rings 130, 140 being also possible.

As seen in FIG. 1, it will be appreciated that the first rotary race 128 is arranged radially inward with respect to the second rotary race 138. Similarly, the first stationary race 124 is arranged radially inward with respect to the second stationary race 134. This arrangement enables a configuration in which the second rolling bearing 132 axially overlaps the first rolling bearing 122 which is provided radially inward of the second rolling bearing 132 as seen in FIG. 1. In other words, the respective axial locations (the bearing width) of the first and second rolling bearing 122, 132 coincide in part or in full. More specifically, in the embodiment of FIG. 1, the stationary races 124, 134 are arranged in between the rotary races 128, 138 such that the first and second rolling bearings 122, 132 have identical axial bearing locations. In other words, as seen in FIG. 1, the first rolling bearing 122 is nested in, i.e. contained inward and inside of, the second rolling bearing 132. This arrangement is made possible by a specific selection of the radial dimensions of the rolling bearings 122, 132. In the configuration of FIG. 1, the rolling path diameter of the innermost first rotary race 128 is smaller than that of the first stationary race 124, which is smaller than that of the second stationary race 134, which in turn is smaller than that of the outermost second rotary race 138. Furthermore, in the embodiment of FIG. 1, the pitch circle diameter of the inward facing first gear ring 130 is smaller than that of the outward facing second gear ring 140. As will be appreciated, a (full) axial overlap of the first and second rolling bearing 122, 132 as illustrated in FIG. 1 allows a considerable reduction of the overall height of construction of the charging device 1 10. Embodiments with a partial axial overlap of the bearings 122, 132, i.e. with the centres of the races of the bearings 122, 132 vertically offset, are also within the scope of the present disclosure. It may be noted in this regard that the schematic drawings are not to scale, since the bearings 122, 132 are scaled up for illustration purposes.

As best seen in FIGS. 8-9, the charging device 1 10 of FIG. 1 comprises a stationary race unit made of a single assembly 880 of double-sided parts having a first inner side with the first stationary race 124 facing radially inward and a second outer side with the second stationary race 134 facing radially outward. As seen in FIG. 1, the double-sided stationary race assembly 880 is fixed immediately to the underside of a top cover plate 70 of the housing 12.

Figure 2:
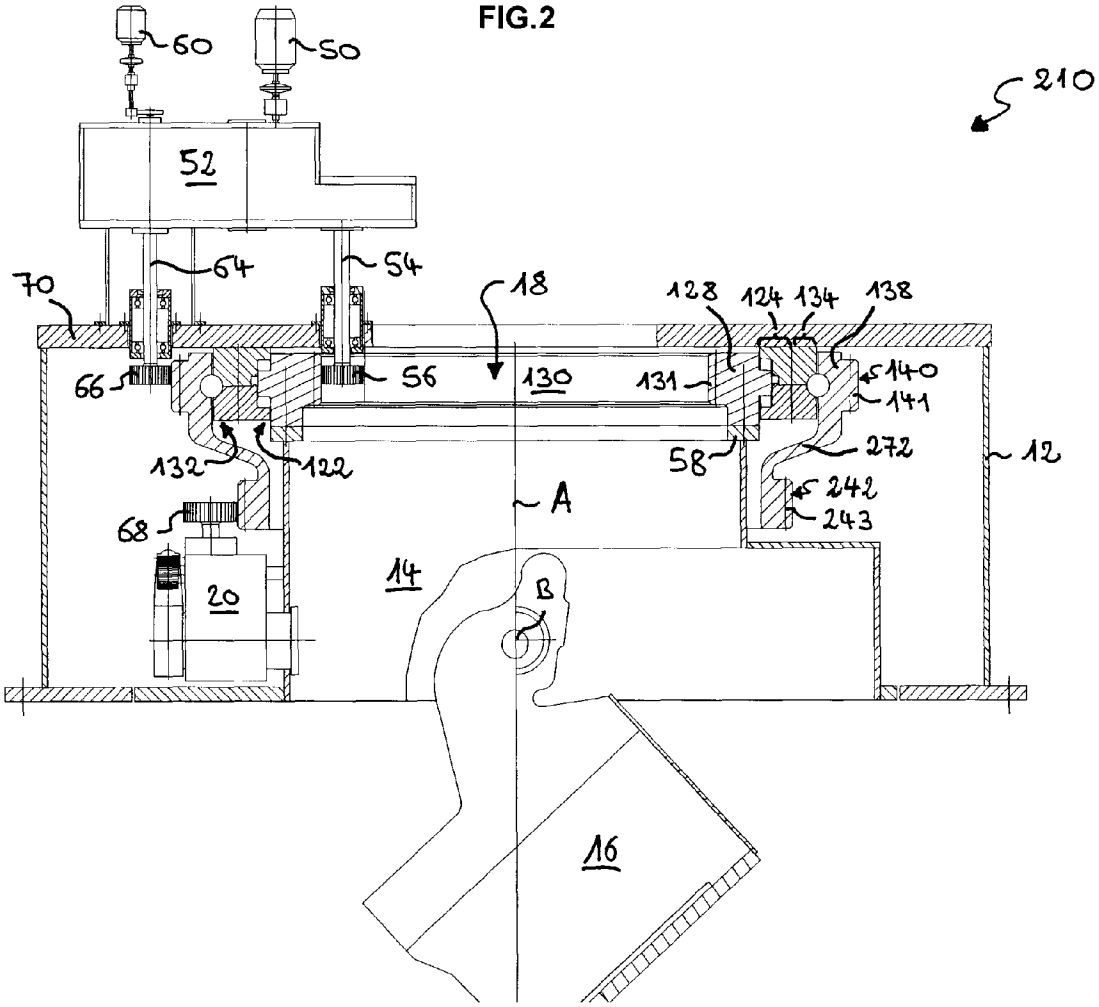
FIG. 2 is a vertical cross sectional view schematically showing a charging device according to a second embodiment.

FIG. 2 shows a further embodiment of a charging device 210, which is similar to that of FIG. 1. In particular, the configuration of the axially overlapping first and second rolling bearings 122, 132 is identical. The only major difference between the charging device 210 and that of FIG. 1 is that the third gear ring 242, whose outward facing teeth 243 mesh with the pair of pinions 68 of the gear boxes 20 has a substantially reduced pitch circle diameter as seen in FIG. 2. To this end, a reducing sleeve 272 is provided by means of which the third gear ring 242 is fixed to or integrally formed with the second gear ring 140. The configuration of FIG. 2 allows locating the gear boxes 20 closer to the axis A, whereby the required horizontal floor space of the device 210 is reduced when compared to the charging device 1 10. Other aspects described hereinbefore in relation to the device 1 10 apply equally to the device 210.

Figure 3:
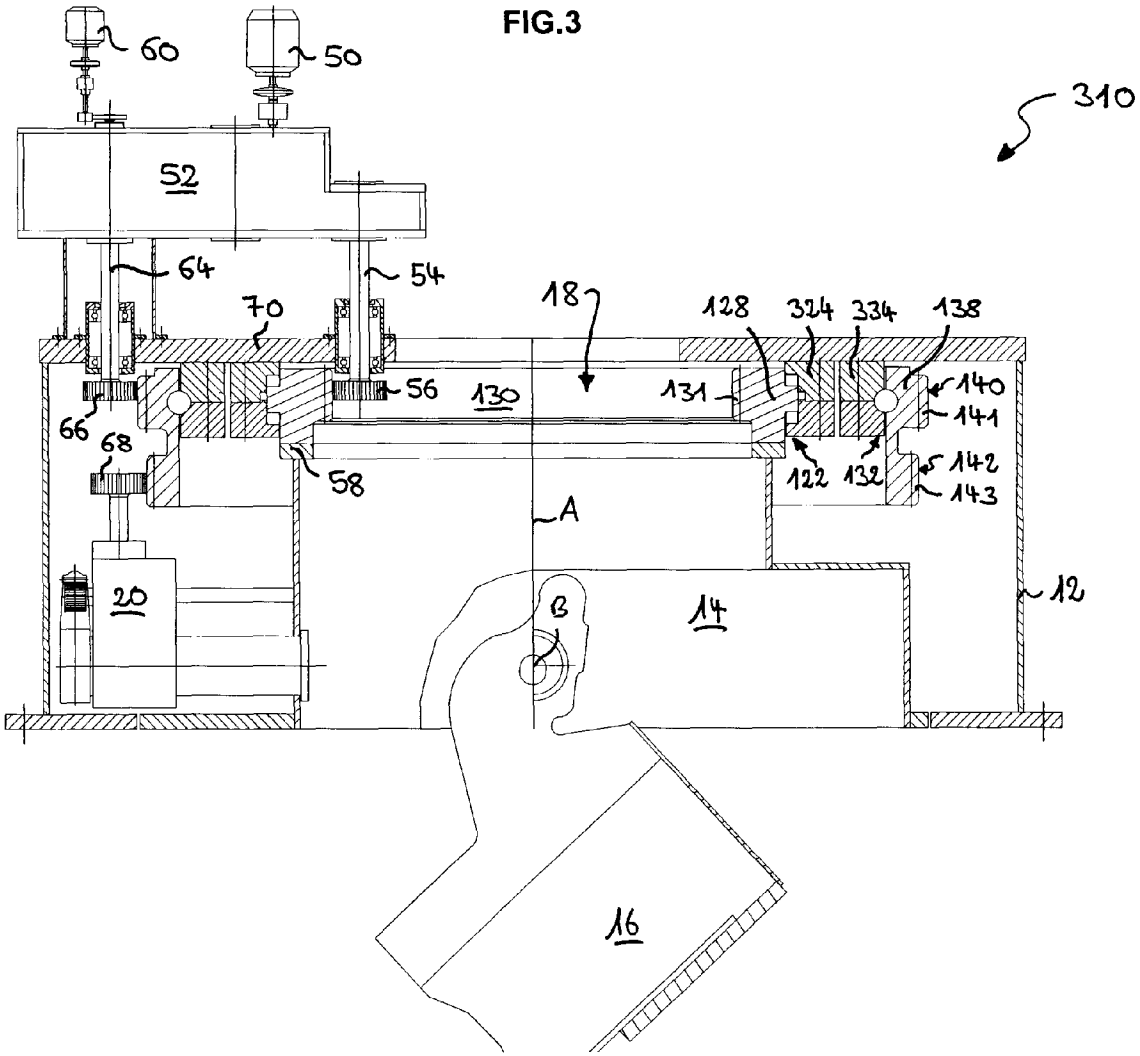
FIG. 3 is a vertical cross sectional view schematically showing a charging device according to a third embodiment.

FIG. 3 shows a further embodiment of a charging device 310, which is also similar to that of FIG. 1. The only major difference between the charging device 310 and that of FIG. 1 is that the charging device 310 comprises a first stationary race 324 and a separate second stationary race 334. In other words, although the stationary races 324 and 334 are arranged as a unit in between the rotary races 128, 138, they are not provided on a single central double-sided race assembly 880 as shown in FIGS. 8-9 but as separate races fixed side-by-side to the underside of the top cover plate 70 of the housing 12. Although this embodiment may require a little more space in radial direction, it may be advantageous in case a double-sided race assembly 880 as shown in FIGS. 8-9 (and FIGS. 1-2 and FIGS. 4-7) is uneconomical or difficult to manufacture for the given application. It shall be noted that this arrangement also enables reduced height of the charging device by virtue of (full) axial overlap of the first and second rolling bearings 122, 132. Other aspects described hereinbefore in relation to the device 1 10 apply equally to the device 310.

Figure 4:
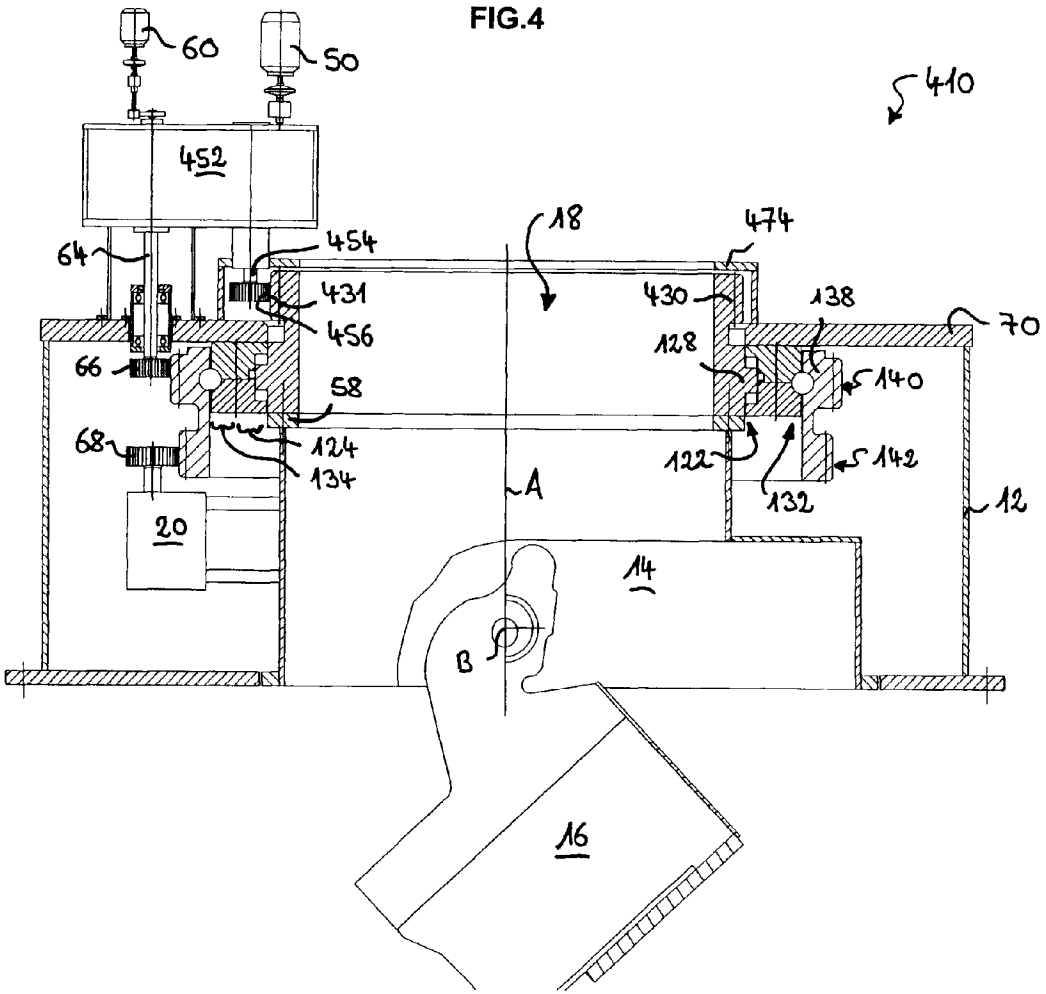
FIG. 4 is a vertical cross sectional view schematically showing a charging device according to a fourth embodiment.

FIG. 4 shows a further, fourth embodiment of a charging device 410. The arrangement of the first and second rolling bearings 122, 132 is identical to that shown in FIG. 1 and FIGS. 8-9. The major difference between the charging device 410 and that of FIG. 1 lies in the arrangement and configuration of the first gear ring 430 as seen in FIG. 4. The first gear ring 430 is arranged with its gear teeth 431 facing radially outward. To this effect, the first gear ring 430 is arranged coaxially above the first rotary race 128 in a protection cover 474 on top of the cover plate 70 of the housing 12. In contrast to FIG. 1, the first gear ring 430 in FIG. 4 meshes with a first pinion 456 on a first shaft 454 arranged radially outward of the first gear ring 430 and the first stationary race 124. Thus the first shaft 454 is offset by a larger distance from axis A. Accordingly, the planetary gear train 452 has a smaller offset between the shafts 454, 64 and has its innermost side arranged at an increased distance of axis A. It follows that the embodiment of FIG. 4 has the advantage of allowing for an increased diameter of the central feed opening 18 when compared to the embodiment of FIG. 1. Other aspects described hereinbefore in relation to the device 1 10 apply equally to the device 410. Similar to FIG. 8 or FIG. 9, the first gear ring 430 can be integrally formed with or, alternatively, fixed as a separate part to the first rotary race 128.

Figure 5:
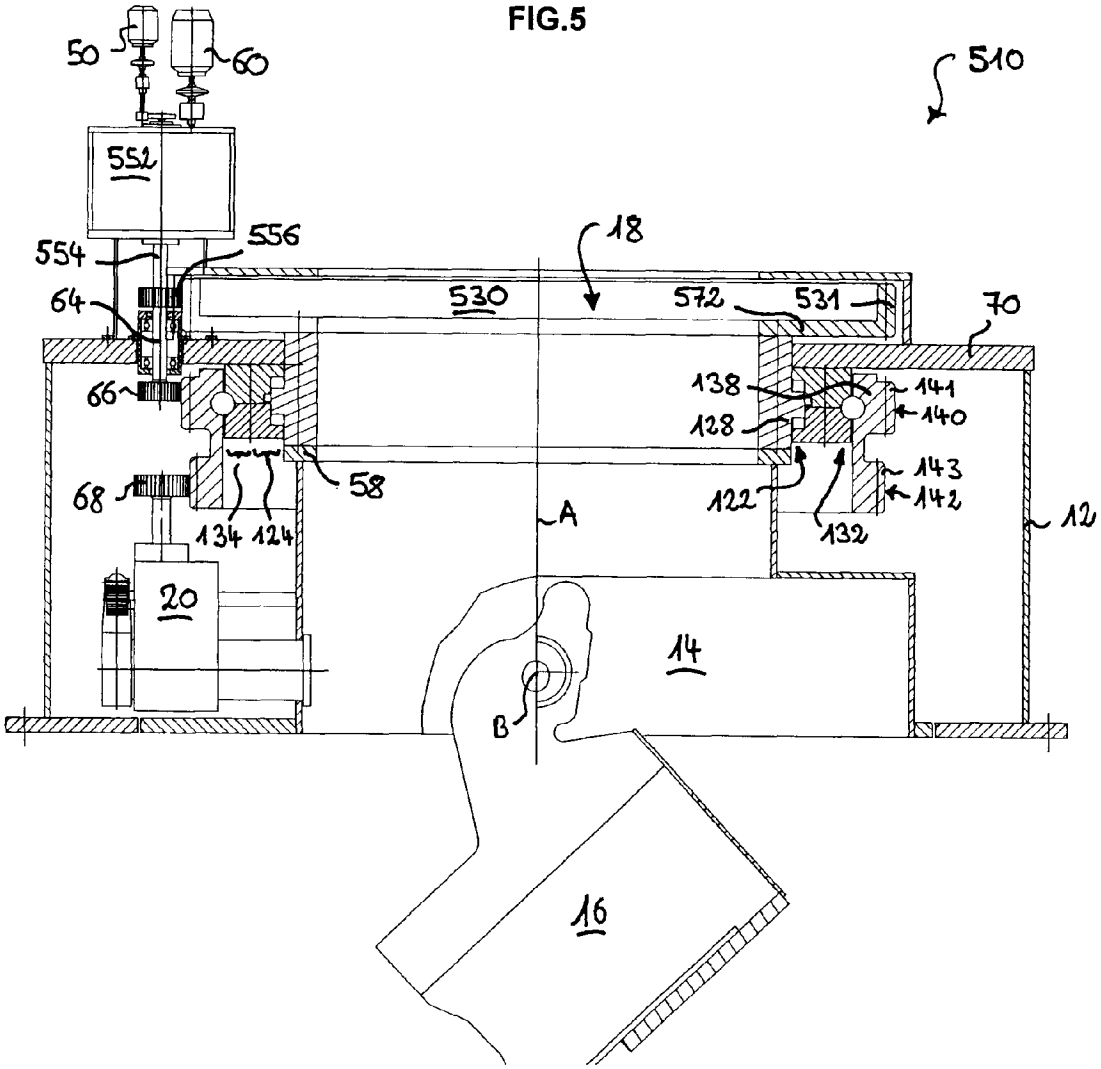
FIG. 5 is a vertical cross sectional view schematically showing a charging device according to a fifth embodiment.

FIG. 5 shows a fifth embodiment of a charging device 510. The arrangement of the first and second rolling bearings 122, 132 is identical to that shown in FIG. 1 and FIGS. 8-9. The charging device 510 is similar to that of FIG. 4. Accordingly, the major difference between the charging device 510 and that of FIG. 1 lies in the arrangement and configuration of the first gear ring 530 as seen in FIG. 5. The first gear ring 530 which fixed as a separate part to the first rotary race 128 by means of an extension sleeve or extension disc is arranged with its gear teeth 531 facing radially outward. Moreover, the first gear ring 530 has a pitch circle diameter identical to that of the second gear ring 140 as seen in FIG. 5. The first shaft 554, which bears the first pinion 556 that meshes with the first gear ring 530, is consequently configured as a hollow shaft through which the second shaft 64 passes coaxially. The planetary gear train 552 is configured accordingly. Thus, the embodiment of FIG. 5 presents essentially the same advantages as the embodiment of FIG. 4. Other aspects described hereinbefore in relation to the device 1 10 apply equally to the device 510.

Figure 6:
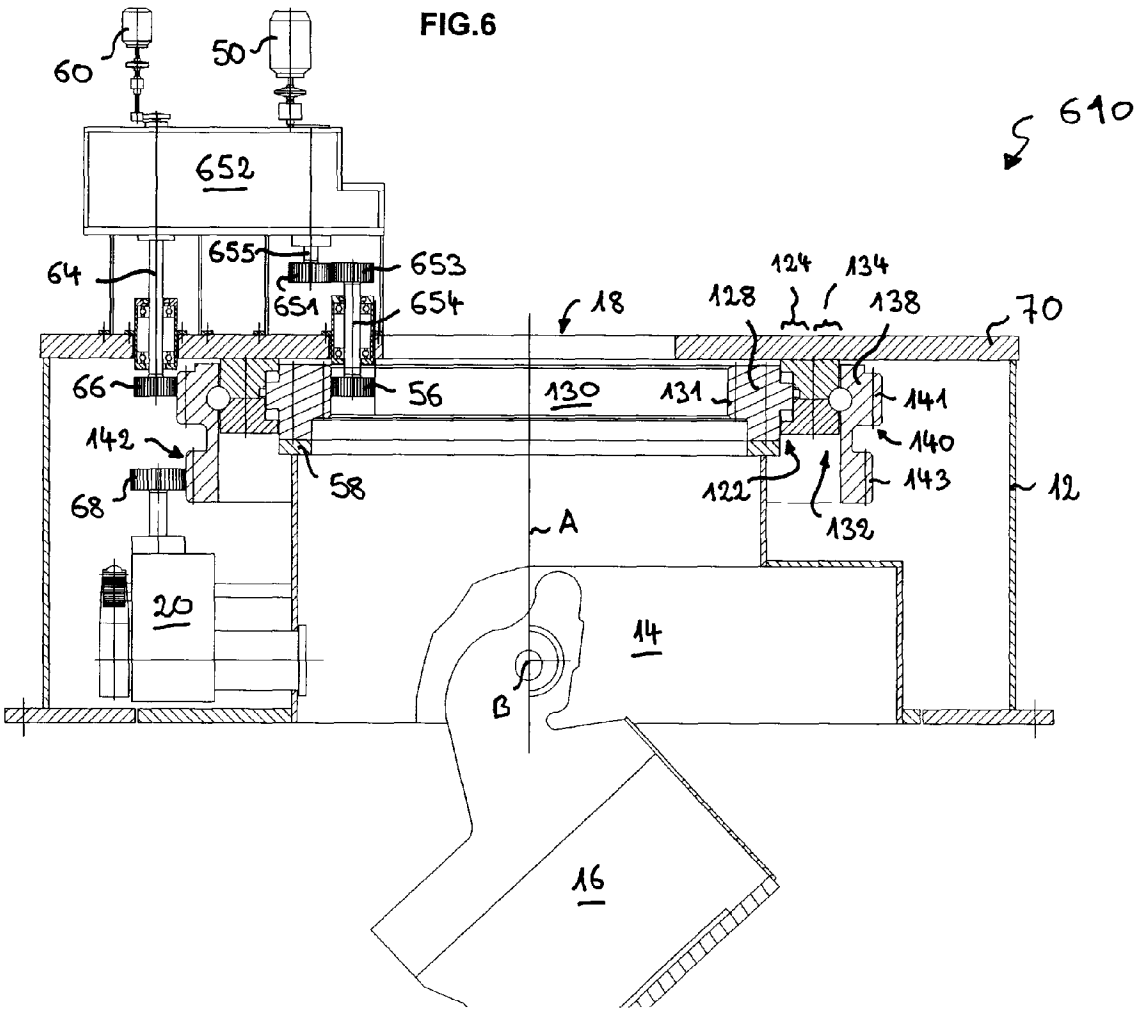
FIG. 6 is a vertical cross sectional view schematically showing a charging device according to a sixth embodiment.

FIG. 6 shows yet another embodiment of a charging device 610. The charging device 610 is in most respects identical to that of FIG. 1. The difference lies in how the first pinion 56 is driven. In the charging device 610 of FIG. 6, the first pinion 56 is supported on the lower end of an intermediate shaft 654, i.e. not directly on a shaft of the planetary gear train 652 as in the previous embodiments. As seen in FIG. 6, an output shaft 655 of the planetary gear train 652 carries a first intermediate pinion 651 that meshes with a second intermediate pinion 653 fixed to the upper end of the intermediate shaft 654. As will be understood, the intermediate gear formed by pinions 651, 653 and shaft 654 allows for a smaller offset between the output shafts 64, 655 of the planetary gear train 652. Accordingly, a planetary gear train 652 of smaller size can be used and additional space around the central feed opening 18 is provided.

Figure 7:
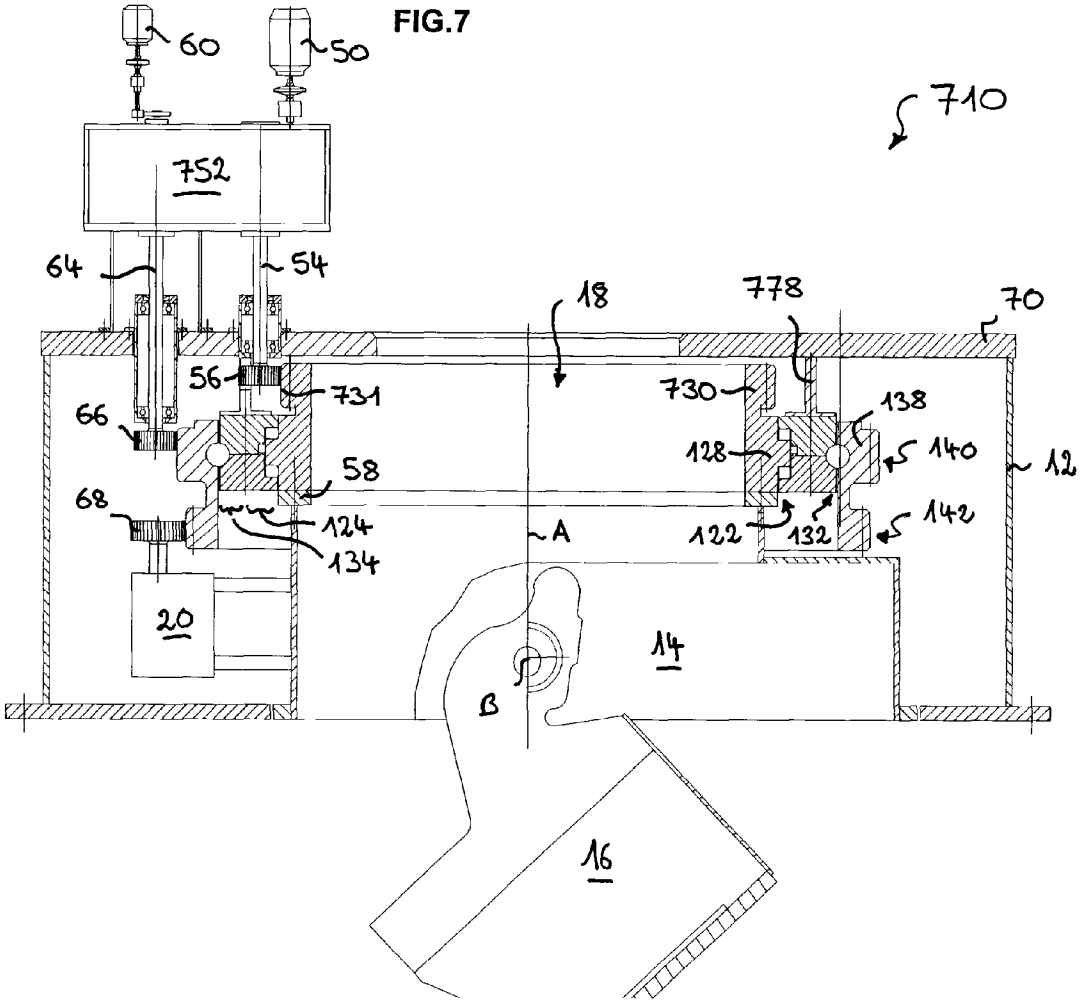
FIG. 7 is a vertical cross sectional view schematically showing a charging device according to a seventh embodiment.

FIG. 7 shows yet another embodiment of a charging device 710, which can be seen as an enhancement of the charging device 410 of FIG. 4. Similar to the embodiment of FIG. 4 and as opposed to those of FIGS. 1-3 & 5-6, the charging device 710 has a first gear ring 730 that is arranged with its gear teeth 731 facing radially outward. The first gear ring 730 is arranged coaxially above the rotary race 128 and attached to or integrally formed with the latter. The main difference with respect to FIG. 4 lies in that the first gear ring 730 is arranged within the housing 12 so that there is no need for an additional protection casing. To this effect, the charging device comprises a ring-shaped spacer sleeve 778 extending downward from the cover plate 70 to provide space for the first pinion 56 and the first gear ring 730 inside the housing 12 as seen in FIG. 7. The stationary race unit with the first stationary race 124 and the second stationary race 134 is attached to the housing 12 at the lower end of this spacer sleeve 778. Accordingly, as in the embodiment of FIG. 4, the charging device 710 of FIG. 7 allows using a planetary gear train 752 of compact design, e.g. as available from prior art installations and provides additional space around the feed opening 18. As will be appreciated, an enhancement of the charging device 510 of FIG. 5 according to the principle shown in FIG. 7 is also within the scope of the present disclosure.

Although FIGS. 1-7 show charging devices 1 10, 210, 310, 410, 510, 610, 710 comprising a distribution chute 16 that is pivotally adjustable about axis B, it will be appreciated that other types of adjustable distribution means can be used in combination with the rolling bearing arrangement of the invention. For example, a distribution chute that is rotatable about is longitudinal axis and allows radial distribution by virtue of the chute shape can be used instead of the pivotally adjustable distribution chute 16. This type of distribution means is disclosed in more detail in European Patent EP 1 453 983. As a further example, a distribution tube that is rotatable about a second vertical axis offset from axis A for positioning the chute outlet above the charging surface may be used while taking advantage of the proposed rolling bearing arrangement. An example of the latter kind is given in Soviet Union Inventor's Certificate SU 1 669 988.

Turning to FIG. 8 and FIG. 9, a preferred configuration of a bearing arrangement for use in the devices 1 10, 210, 410, 510, 610, 710 will be described in more detail. The bearing arrangements of FIG. 8 and FIG. 9 comprise an inner first rolling(-element) bearing 122 and an outer second rolling(-element) bearing 132. The axes of rotation of the bearings 122, 132 are coaxial (axis A). As seen in FIGS. 8-9, the stationary race unit is a central single double-sided assembly 880 that has an inner side that forms the first stationary race 124 and an outer side that forms the second stationary race 134. Thus the single coherent assembly 880 bears the two rotary races 128, 138 on its opposite lateral faces. Accordingly, the respective stationary races 124, 134 are arranged in between their respective rotary races 128, 138. The double-sided assembly 880 has a generally annular shape and is made of an assembly of an upper and a lower part as seen in FIGS. 8-9, each part being double-sided to provide a portion of stationary race track on either of its sides. This allows a nose protruding radially outward of the rotary race 128 to be included in the inner stationary race 124. The assembly 880 provides an identical axial bearing location for both bearings 122, 132. The first bearing 122 is a combined radial and axial thrust bearing of any suitable type. In the illustrated embodiments, it has two groups of rollers 125, 127 for bearing axial load and one group of rollers 126 for bearing radial load. Although the second bearing 132 is illustrated as a ball bearing comprising a group of balls 135, the rolling elements of the second bearing 132 may be of any suitable type. As further shown in FIGS. 8-9, the annular inner rotary race 128 has gear teeth 131 integrally formed thereon. The gear teeth 131 face radially inward and form a first gear ring 130. Similarly, the annular outer rotary race 138 has gear teeth 141 integrally formed thereon, which form a second gear ring 140. An additional gear ring 142, 142' may be formed integrally with the second outer gear ring 140 (FIG. 8) or attached as a separate part thereto (FIG. 8). Although not shown in FIGS. 8-9, the stationary race assembly 880 is provided with lubricant channels for lubrication of the groups of rolling elements 125, 126, 127, 135 and their rolling paths.

While the present patent application as filed in principle concerns the invention as defined in the claims attached hereto, the person skilled in the art will readily understand that the description of FIGS. 8-9 hereinabove contains support for the definition of another invention relating to the bearing arrangement, i.e. the assembly 880 as such. This further invention could e.g. be claimed as subject matter of amended claims in the present application or as subject matter of claims in divisional and/or continuation applications. Such subject matter could be defined by any feature or combination of features disclosed hereinbefore.

Finally, the main advantages of the proposed bearing arrangement will be briefly recapitulated. The axial overlap of the bearings 122, 132; 622, 632 allows a device construction of reduced overall height. Furthermore, in case of combined stationary races in the form of double-sided assembly 880, manufacturing and assembly cost of the device may be reduced. The proposed arrangement also contributes to simplifying on-site assembly of the charging device among others because the rotatable structure 14 can be mounted to the housing 12 by means of a single connection flange 58 in a simple procedure, and because mounting of the bearings 122, 132 is facilitated.

The invention claimed is:

1. A charging device for distributing bulk material in an enclosure, said device comprising:

a stationary housing supporting a rotatable structure, said rotatable structure carrying adjustable distribution means so that rotation of said rotatable structure allows circumferential distribution of bulk material and adjustment of said distribution means allows radial distribution of bulk material;

a first drive for rotating said rotatable structure;

a second drive for adjusting said distribution means;

a first rolling bearing comprising a first stationary race bearing a first rotary race coupled to a first gear ring that cooperates with said first drive for rotating said rotatable structure;

a second rolling bearing comprising a second stationary race bearing a second rotary race coupled to a second gear ring that cooperates with said second drive for adjusting said distribution means;

further comprising a stationary race unit having an inner side presenting said first stationary race and an outer side presenting said second stationary race such that said first rotary race is arranged radially inward with respect to said second rotary race, said first stationary race is arranged radially inward with respect to said second stationary race and said second rolling bearing axially overlaps said first rolling bearing.

2. The charging device according to claim 1, wherein said stationary race unit is made of a single assembly of double-sided parts.

3. The charging device according to claim 1, wherein said stationary race unit is made of a first stationary race and a separate second stationary race arranged proximate to said first stationary race.

4. The charging device according to claim 1, wherein said stationary races are arranged such that said first and second rolling bearings have identical axial bearing locations.

5. The charging device according to claim 1, wherein said first gear ring for rotating said rotatable structure has a smaller pitch circle diameter than said second gear ring for adjusting said distribution means.

6. The charging device according to claim 1, wherein said first rotary race and said first gear ring are integrally formed and/or said second rotary race and said second gear ring are integrally formed.

7. The charging device according to claim 1, wherein said first gear ring has gear teeth facing radially inward and said second gear ring has gear teeth facing radially outward.

8. The charging device according to claim 1, wherein said distribution means comprise an angularly adjustable distribution chute, said chute being mounted pivotable about a pivoting axis perpendicular to the axis of rotation of said rotatable structure, and an adjustment transmission operable by means of said second gear ring for setting a pivoting angle of said distribution chute.

9. The charging device according to claim 1, wherein said first rolling bearing is a combined radial-and-axial-thrust roller bearing and said stationary housing supports said rotatable structure by means of said first rolling bearing.

10. The charging device according to claim 9, wherein said rotatable structure is fixed by means of a connection flange to said first rotary race.

11. The charging device according to claim 1, wherein said stationary housing comprises a top cover plate and said first and second stationary races are attached immediately to an underside of said top cover plate.

12. A charging device for distributing bulk material in a metallurgical reactor, said charging device comprising:

a stationary housing supporting a rotatable structure that is rotatable about an axis of rotation, said rotatable structure comprising:

an angularly adjustable distribution chute that is mounted pivotable about a pivoting axis that is perpendicular to said axis of rotation, and an adjustment transmission for setting a pivoting angle of said distribution chute about said pivoting axis;

so that rotation of said rotatable structure allows circumferential distribution of bulk material and pivoting said distribution chute allows radial distribution of bulk material with respect to said axis of rotation;

a first drive and a first gear ring that cooperates with said first drive for rotating said rotatable structure;

a second drive and a second gear ring that cooperates with said second drive for pivoting said distribution chute;

a first rolling bearing comprising a first stationary race and a first rotary race borne by said first stationary race and coupled to said first gear ring for rotating said rotatable structure;

a second rolling bearing comprising a second stationary race and a second rotary race borne by said second stationary race and coupled to said second gear ring for pivoting said distribution chute; and a stationary race unit having an inner side with said first stationary race and an outer side with said second stationary race such that said first rotary race is arranged radially inward with respect to said second rotary race and said first stationary race is arranged radially inward with respect to said second stationary race.

13. The charging device according to claim 12, wherein said stationary race unit comprises an assembly of double-sided parts.

14. The charging device according to claim 12, wherein said stationary race unit comprises a first stationary race and a separate second stationary race, said second stationary race being arranged proximate to said first stationary race.

15. The charging device according to claim 12, wherein said stationary races are arranged such that said first and second rolling bearings have identical axial bearing locations so that said second rolling bearing axially overlaps said first rolling bearing.

16. The charging device according to claim 12, wherein said first gear ring has a smaller pitch circle diameter than said second gear ring and wherein said first rotary race and said first gear ring are integrally formed and/or said second rotary race and said second gear ring are integrally formed.

17. The charging device according to claim 16, wherein said first gear ring has gear teeth facing radially inward and said second gear ring has gear teeth facing radially outward with respect to said axis of rotation.

18. The charging device according to claim 12, wherein said first rolling bearing is a combined radial-and-axial-thrust roller bearing, said first stationary race is fixed to said stationary housing and said rotatable structure is fixed to said first rotary race.

19. The charging device according to claim 18, wherein said stationary housing comprises a top cover plate and said first stationary race and said second stationary race are attached to an underside of said top cover plate.

20. A blast furnace charging device comprising:

a stationary housing supporting a rotatable structure carrying an angularly adjustable distribution member so that rotation of said rotatable structure allows circumferential distribution of bulk material and angular adjustment of said distribution member allows radial distribution of bulk material;

a first drive for rotating said rotatable structure and a second drive for adjusting said distribution member;

a stationary race unit having an inner side with a first stationary race and an outer side with a second stationary race;

a first rotary race that is borne by said first stationary race and that is coupled to a first gear ring that cooperates with said first drive for rotating said rotatable structure; and a second rotary race that is borne by said second stationary race and that is coupled to a second gear ring that cooperates with said second drive for adjusting said distribution member;

wherein said first rotary race is arranged radially inward with respect to said second rotary race and said first stationary race is arranged radially inward with respect to said second stationary race.

* * * * *